US006358888B1

(12) United States Patent
Eckels

(10) Patent No.: US 6,358,888 B1
(45) Date of Patent: Mar. 19, 2002

(54) SHIELDED SUPERCONDUCTING MAGNET JOINTS

(75) Inventor: Phillip William Eckels, Florence, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/472,687

(22) Filed: Dec. 27, 1999

(51) Int. Cl.[7] ..... H01R 43/00
(52) U.S. Cl. ..... 505/925
(58) Field of Search ..... 174/125.1; 505/925, 505/926, 927

(56) References Cited

U.S. PATENT DOCUMENTS 3,422,529 A * 1/1969 Nuding ..... 29/599
3,449,818 A * 6/1969 Lowe ..... 505/925
3,559,128 A * 1/1971 Kingston et al. ..... 335/216
4,797,510 A * 1/1989 Mihelich ..... 174/94 R
5,231,366 A * 7/1993 Haramaki et al. ..... 335/216
5,292,051 A * 3/1994 Nagahiro ..... 228/179.1
5,382,904 A * 1/1995 Pissanetzky ..... 324/319
5,583,319 A * 12/1996 Lieurance ..... 505/925
5,818,319 A * 10/1998 Crozier et al. ..... 335/299

FOREIGN PATENT DOCUMENTS

GB 2 260 446 A * 4/1993 ..... H01F/7/22

* cited by examiner

*Primary Examiner*—Neil Abrams
(74) *Attorney, Agent, or Firm*—Irving M. Freedman; Christian G. Cabou; Michael A. Della Penna

(57) ABSTRACT

A magnetic shield for a superconducting joint in a superconducting magnet coil includes a superconducting tubular shield of superconducting materials surrounding the joint. The shield extends on either side of the joint a distance equal to the inside diameter of the shield. The coil is wound with niobium titanium conductors. The superconducting shield produces a field anomaly that influences the homogeneity of the imaging volume and an acceptable disturbance in the imaging volume while at the same time providing an ambient field condition that allows the superconducting joint to have a sufficiently low resistance to minimize superconducting current capacity degradation.

17 Claims, 1 Drawing Sheet

SHIELDED SUPERCONDUCTING MAGNET JOINTS

BACKGROUND OF INVENTION

This invention relates to superconducting joints for conductors used in winding coils for superconducting magnets of the type used for magnetic resonance imaging (hereinafter "MRI").

In the winding of superconducting coil for use in MRI superconducting magnets the end of the superconducting conductor on the spool feeding the winder is frequently reached leading to the necessity to splice or join a superconductor from a new spool to the end. However, present joints or splices for joining superconducting magnet conductors produce a joint region degraded in superconducting performance when compared to the continuous long length of superconductor. Superconducting joints produce a magnetic field homogeneity that disturbs the homogeneity of the imaging field and hence degrades imaging quality. An example is PbBi cast joints which have a 1.5 Tesla critical field. For this reason, superconducting joints are usually made in regions of the magnet coil array where the joints are exposed to lower magnetic fields and better cooling, that is in less critical and demanding regions. Such constraints are inconvenient and highly undesirable from a manufacturing viewpoint. Moreover, such joints can degrade the superconducting current carrying and produce field harmonics undesirable in the imaging volume, and increase the risk of lead wire motion and induced quenches or undesired cessation of superconducting operation. Such joints are also expensive to manufacture, and inhibit freedom of design. For example, if a magnet design requires a pocket of reversed current turns to achieve satisfactory homogeneity, lead routing to low field regions can preclude use of this technique. Lead routing with many coils or subdivided coils in a superconducting magnet can also provide further undesirable constraints on the use of such joints.

Still further, the superconducting joint has to be of low electrical resistance to avoid heating and power losses at the joint.

The above conflicting considerations and constraints have resulted in less than satisfactory superconducting joints and in joints which are not suitable for a number of diverse applications. This has led to considerable research and development aimed at improving superconducting joints and in obtaining superconducting joints which are suitable for the many diverse joint requirements encountered in the design and fabrication of superconducting magnets.

BRIEF SUMMARY OF INVENTION

Thus, there is a particular need for superconducting joints which overcome or minimize the aforementioned problems.

In accordance with one form of the invention, a superconducting magnet coil joint is provided in which pigtails are twisted to form a joint, and a hollow superconducting sleeve is positioned around the joint. The superconducting sleeve extends on either side of the joint a distance of one-half inside diameters of the sleeve. The sleeve is a stabilized superconducting material, such as niobium titanium to exclude the main magnetic field of the coil and minimize superconducting current capacity degradation.

DETAILED DESCRIPTION OF THE INVENTION

Figure 1:
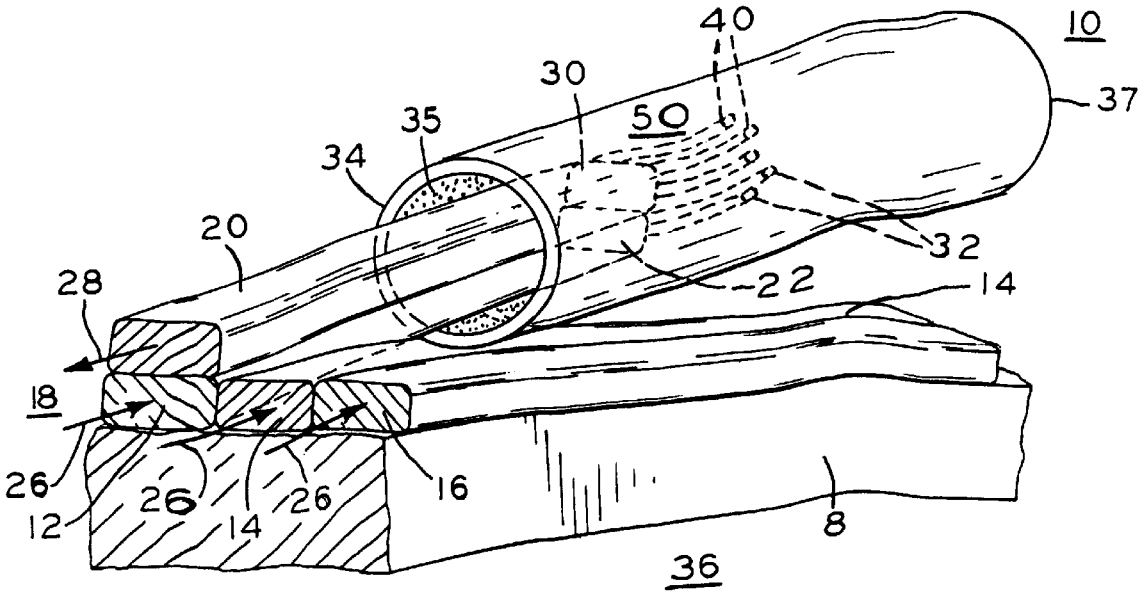
FIG. 1 is a cut-away perspective view of a superconducting magnet joint illustrating the present invention.
Figure 2:
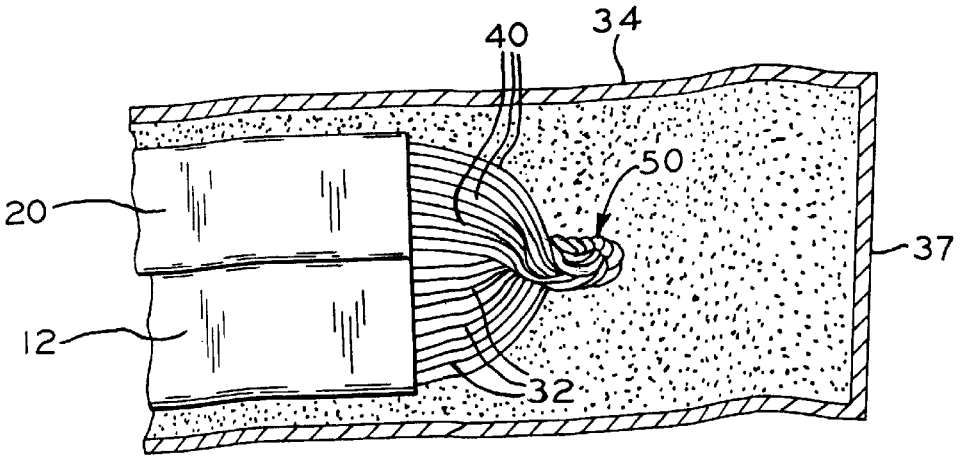
FIG. 2 is an enlarged view of a portion of FIG. 1.

Referring to FIGS. 1 and 2, a plurality of adjacent turns 12, 14 and 16 of niobium-titanium (NbTi) 60×90 mill ribbon or tape are wound from a spool (not shown) to form superconducting magnet coil 10. Turns 12, 14 and 16 are wound side by side and supported on coil form 8 to form layers such as 18 of magnet coil 10. Coil form 8 is fabricated of filament-wound glass epoxy. End 30 of superconductive layer or superconducting conductor 20 which overlies conductor 12 of layer 18 is joined to end 22 of conductor 12 to form joint 50 as described in detail below. The joinder of conductors is required in order to continue winding superconducting magnet coil 10 when the end of conductor 20 from the spool used in winding the coil is reached.

The ends 22, 30 of conductors 12, 20, respectively, are dipped in molten tin to dissolve off the copper matrix commonly associated with the NbTi conductors providing a plurality of tin coated "pigtails" or NbTi strands 32 and 40 which make up the conductors. Strands 32 and 40 are then twisted together to electrically connect ends 22 and 30 of conductors 12 and 20, respectively, and together to form joint 50 as best shown in FIG. 2.

Hollow tube or canister shield 34 of a high or low temperature superconducting material is then placed around superconducting joint 50. In one embodiment shield 34 was Niobium titanium (NbTi) with an inside radius of 0.08 inches, an outside radius of 0.1875 and a length of 1.625 inches. That is, the axial length of shield 34 is approximately the length of joint 50 plus twice the inside diameter of shield 34. The shield extends beyond the joint at each end a distance at least equal to the inside diameter of the shield. The ratio of the extension of shield 34 beyond joint 50 to the internal diameter of shield 34 preferably varies from 0.5 to 1.5 or more.

A lead bismuth (PbBi) alloy 35 may be flowed into the interior of hollow cylinder 34 around conductors 12 and 20 filling the open spaces.

In operation, shield cylinder 34 is superconducting when magnet coil 10, including coil turns 12, 14, 16 and 20, is superconducting. As magnet coil 10 is ramped up to field, tubular shield 30 excludes the external magnetic field in bore 36 from superconducting joint 50 by maintaining initial magnetic flux linkages of the shield cylinder. The direction of current flow in the spliced or joined conductors 12 and 20 which overlie one another may be in opposite directions as indicated by arrows 26 and 28 in FIG. 1. The reversing magnetic field effect resulting from the reversed current flow tends to cancel and minimize the effect of joint 50 on the main magnetic imaging field in bore 36. This enables superconducting joint 50 to operate at nearly zero field even though it may be within an ambient external field of up to 5 Tesla, or even more. As a result, the current carrying capability of the PbBi is increased.

It has been found that superconducting joint 50 holds the interior magnetic field within cylinder shield 34 at 2 Tesla in the presence of an exterior magnetic field 36 within bore 36 of superconducting magnet 10 at 4 Tesla, and with an acceptable inhomogeneity of 4.7 parts per million (ppm) in the imaging volume of bore 36. A normal limit of 10 ppm inhomogeneity is acceptable.

Space within superconducting tubular shield 30 may be filled with molten lead bismuth 35 which would dissolve the tin off the copper portion of strands 32 and 40. Also, tubular shield 30 may have a closed end 37 positioned beyond the ends of strands 32 and 40 with strands 32 and 40 positioned inside. Joint 50 can then be cast directly into the shield cylinder using lead bismuth.

While the present invention has been described with respect to certain preferred embodiments thereof, it is to be understood that numerous variations and details of construction, the arrangement and combination of parts, and the type of materials used may be made without departing from the spirit and scope of the invention.

What is claimed is:

1. A superconducting magnetically shielded joint for use in joining conductors intermediate the ends of magnetic resonance imaging superconducting magnet coils comprising:

a superconducting magnet coil including a plurality of turns of a first superconducting conductor wound on a coil form to provide an ambient magnetic field within said coil;

a joint connecting the end of a second superconducting conductor to the end of said first superconducting conductor enabling continued winding of said second superconducting conductor to finish said magnet coil on said form;

said joint forming part of the winding of said superconducting magnet coil and positioned on said form in said winding;

a hollow tube magnetic shield positioned around said joint;

said tube being superconducting material which extends beyond each end of said joint a distance equal to the inside diameter of said hollow shield;

whereby said tube shields said joint from said ambient magnetic field and minimizes effects of said joint on the magnetic homogeneity provided by said magnetic coil.

2. The superconducting joint of claim 1 whereby said first and second superconducting conductors overlie one another on said coil form and the extending ends thereof are joined to form said joint.

3. The superconducting joint of claim 2 wherein said joint is at zero field when the ambient magnetic field outside said shield is in excess of 5 Tesla.

4. The superconducting joint of claim 2 wherein said shield is a hollow cylinder.

5. The superconducting joint of claim 4 wherein the current flow in the joined connectors flows in opposite directions.

6. The superconducting joint of claim 4 wherein said shield has a closed end surrounding said joint.

7. The superconducting joint of claim 6 wherein said joint is cast directly into said shield cylinder using PbBi to fill the space therebetween.

8. The superconducting joint of claim 4 wherein said joint is a pigtail wire joint and said superconducting conductors are ribbon conductors of multiple strands.

9. The superconducting joint of claim 4 wherein said strands are spliced together and the resultant splice is positioned within said shield cylinder.

10. The superconducting joint of claim 2 wherein the ratio of the extension of said shield beyond said joint to the internal diameter of said shield is in excess of 0.5.

11. The superconducting joint of claim 10 wherein said ratio is in the range of 0.5 to 1.5.

12. The superconducting joint of claim 11 wherein said shield is approximately 1.6 inches long and extends beyond each end of said joint approximately 0.16 inches.

13. A superconducting magnetic field for a joint of superconducting conductors for use in a superconducting magnet coil intermediate the ends of said coil to shield said joint from the magnetic field generated by said superconducting magnet comprising:

a superconducting tube overlying said joint to magnetically shield said superconducting joint;

said tube extending on either side of side joint a distance in the order of the internal diameter of said tube;

the space between said tube and said superconducting member is filled with cast PbBi alloy;

said distance being selected such that said superconducting tube maintains its initial magnetic flux linkages upon ramping up of said superconducting magnet to exclude the effects of said magnetic field.

14. The superconducting joint of claim 13 wherein said tube is 0.1 inches thick NbTi.

15. The superconducting joint of claim 14 wherein said conductors are joined in a joint selected from a pigtail joint and a twisted joint.

16. The superconducting joint of claim 15 where said conductors are NbTi.

17. The superconducting joint of claim 16 wherein the axial length of said tube is in excess of 1.5 inches.

* * * * *